3/14/78 XR 4,078,609

United States Patent [19]

Pavlich

[11] 4,078,609

[45] Mar. 14, 1978

[54] METHOD OF FRACTURING A SUBTERRANEAN FORMATION

[75] Inventor: Joseph P. Pavlich, Houston, Tex.

[73] Assignee: The Dow Chemical Company, Midland, Mich.

[21] Appl. No.: 782,268

[22] Filed: Mar. 28, 1977

[51] Int. Cl.[2] ..... E21B 43/26

[52] U.S. Cl. ..... 166/271; 166/280; 166/308

[58] Field of Search ..... 166/271, 259, 280, 283, 166/308

[56] References Cited

U.S. PATENT DOCUMENTS

| | | | |
|---|---|---|---|
| 3,058,909 | 10/1962 | Kern | 166/283 |
| 3,151,678 | 10/1964 | Hanson et al. | 166/280 |
| 3,245,470 | 4/1966 | Henry | 166/280 |
| 3,335,797 | 8/1967 | Braunlich, Jr. | 166/280 |
| 3,592,266 | 7/1971 | Tinsley | 166/283 |
| 3,642,068 | 2/1972 | Fitch et al. | 166/308 X |
| 3,710,865 | 1/1973 | Kiel | 166/308 |
| 3,850,247 | 11/1974 | Tinsley | 166/280 |
| 3,933,205 | 1/1976 | Kiel | 166/308 |
| 3,948,325 | 4/1976 | Winston et al. | 166/308 |
| 3,974,077 | 8/1976 | Free | 166/308 |

*Primary Examiner*—Stephen J. Novosad
*Attorney, Agent, or Firm*—Glenn H. Korfhage

[57] ABSTRACT

A fracturing method wherein (a) a viscous, prop free fluid is injected into a new or preexisting fracture to widen and extend the fracture, (b) a viscous prop carrying fluid is injected in one or more stages, (c) a viscous prop free spacer is injected, (d) a low viscosity inefficient penetrating fluid is injected, all of the foregoing being injected at rates and pressures calculated to prevent said fracture from healing, (e) injection of fluids at rates and pressures calculated to prevent said fracture from healing is ceased (including the embodiments of injecting a low viscosity penetrating fluid at a matrix rate, ceasing injection entirely, flowing back the well, or a combination thereof), and thereafter at least steps (a) and (b) are repeated.

18 Claims, 19 Drawing Figures

METHOD OF FRACTURING A SUBTERRANEAN FORMATION

BACKGROUND OF THE INVENTION

A. Field of the Invention

This invention relates to a method of hydraulically fracturing a subterranean formation, particularly a hydrocarbon bearing formation though equally applicable to water or steam bearing formations, penetrated by a borehole, and more particularly relates to a method of hydraulic fracturing wherein fluids are injected in a series of stages to create multiple fractures.

B. Description of the Prior Art

The art of hydraulic fracturing of subterranean formations is well known.

Various techniques have been proposed for placing propping agents in fractures to prevent the fractures from completely closing, or "healing", when the wellhead pressure is relieved. Most involve the injection of multiple stages of fluids. Henry, U.S. Pat. No. 3,245,470 employed alternating foam stages to achieve deposition of proppant. Braunlich, Jr., U.S. Pat. No. 3,335,797 teaches a method for controlling the downward growth of fractures by a prop placement technique. Hanson et al., U.S. Pat. No. 3,151,678, teach to impart a surging action to the proppant as it is injected. Tinsley in U.S. Pat. Nos. 3,592,266 and 3,850,247 teaches methods whereby an effort is made to prop the fracture at intermittently spaced intervals.

Kiel, U.S. Pat. No. 3,933,205, and Winston, U.S. Pat. No. 3,948,325, teach methods of fracturing for creating multiple fractures, wherein the formation is permitted to heal at least partially between injection stages. In Kiel, the intermediate healing step is said to create spalling of the fracture faces. In Winston, the relaxation step following injection of what the patentee calls a "Bingham plastic fluid" is said to create a long plug against which a pressure can be applied to create a second fracture. In both Kiel and Winston, the high viscosity fluid may carry a proppant. Where Kiel employs a proppant, he teaches to follow the proppant stage with a viscous flush, e.g. Super Emulsifrac fluid having no proppant, prior to the healing step. See, for example, the treatment report in columns 21 and 22, Event Nos. 8–10. Winston teaches the Bingham plastic fluid may contain a propping agent (col. 4, line 22,) and may be followed by displacement fluid (col. 3, lines 32–34). In Example 1, Winston follows a borate gelled guar fluid containing proppant with a water stage prior to relieving pressure. In neither Kiel nor Winston, however, is it taught to follow the proppant stage with both a viscous, proppant free spacer and a non-viscous proppant free fluid, prior to the relaxation step.

SUMMARY OF THE INVENTION

The present invention is an improved method of hydraulic fracturing wherein at least two, and preferably several, stages of a non-Newtonian fracturing fluid carrying a solid are injected into a preexisting or newly created fracture at a fracturing rate and pressure, and fluid injection rates and pressures are temporarily substantially reduced at least once between the first and last stages of solids-carrying fluid to permit the fracture to close at least partially. The improvement comprises: immediately prior to the temporary rate and pressure reducing step, injecting in sequence both (a) a non-Newtonian viscous fracturing fluid substantially free of solids and (b) an inefficient penetrating fluid substantially free of solids. In a preferred embodiment, the temporary pressure reducing step consists of injecting an inefficient penetrating fluid at a matrix rate, although it may comprise injecting said inefficient fluid at a matrix rate, complete temporary cessation of injection of all fluids, backflowing the well, or a combination of two or more of the foregoing.

Continuation of fracturing after a fracture healing step has been shown to create multiple fractures. The proppant free viscous spacer is believed to assist in transporting the proppant to the extremeties of each respective fracture, and the penetrating fluid is believed to dilute or displace the viscous fluids from the fracture once the proppant is in place, thereby permitting more rapid healing of the fractures without dislodging the proppant. Also, because the rate of fluid loss of the inefficient fluid to the formation will exceed that of the viscous fluid, slight healing of the fracture is believed realized near the conclusion of the stage of inefficient fluid injection carried out at a high injection rate, thereby gradually placing sufficient pressure on the proppant to minimize movement of the proppant as the injection rate and pressure are substantially reduced during the subsequent principal healing step.

BRIEF DESCRIPTION OF THE DRAWINGS

FIG. 1 shows a vertical fracture in the formation after initiation of the fracture with a conventional fracturing fluid.

FIG. 2 shows the formation as a solids-free high viscosity non-Newtonian fluid is injected as a pad to extend and widen the fracture sufficiently so that a particulate may be injected into the fracture.

FIG. 3 shows the fracture as a high viscosity non-Newtonian fluid carrying a solid particulate is being injected.

FIG. 4 shows the fracture as a solids-free high viscosity non-Newtonian fluid is injected as a displacement fluid, i.e. as a spacer.

FIG. 5 shows the fracture as a low viscosity solids-free penetrating fluid is injected substantially at a fracturing rate.

FIG. 6 shows the fracture after the viscous fluids have been substantially displaced, diluted, or rendered substantially non-viscous by the non-viscous penetrating fluid, and additional penetrating fluid is being injected at a matrix rate.

FIG. 7 shows the fracture as a second stage of solids-free high viscosity non-Newtonian pad fluid is injected into the formation to create a secondary fracture.

FIG. 8 shows the fracture as a second stage of a high viscosity non-Newtonian fluid carrying a solid particulate is being injected.

FIG. 9 shows the fracture as a second stage of a solids-free high viscosity non-Newtonian spacer fluid is being injected.

FIG. 10 shows the fracture as a second stage of a low viscosity solids-free penetrating fluid is injected at substantially at a fracturing rate.

FIG. 11 shows the fracture after the viscous fluids of stage two have been substantially displaced, diluted, or rendered substantially non-viscous by the non-viscous penetrating fluid, and additional penetrating fluid is being injected at a matrix rate, thereby permitting the fracture to heal upon the emplaced solid particulate.

FIG. 12 shows the fracture after the series of injections has been repeated for the final (-Fth) time and the fracture system is completely filled with proppant, following X preceding cycles each of which filled less than the entire fracture system with proppant.

FIG. 13 shows the fracture from above as the first stage of low viscosity solids-free fluid is injected at a matrix rate, and the first stage of solids is fixed in place at the extremeties of the fracture.

FIG. 14 shows the fracture at the conclusion of the second stage, after formation of secondary fractures and fixation of the injected solids in the extremeties of the fracture.

FIGS. 15–17 show the fracture at the conclusion of the third through Xth cycles, respectively.

FIG. 18 shows the fracture at the conclusion of the treatment, with the final stage of proppant substantially completely filling the fracture back to the immediate viscinity of the wellbore.

FIG. 19 shows another embodiment wherein the proppant is injected in several stages prior to injection of a penetrating fluid.

DESCRIPTION OF THE PREFERRED EMBODIMENTS

Figure 1:
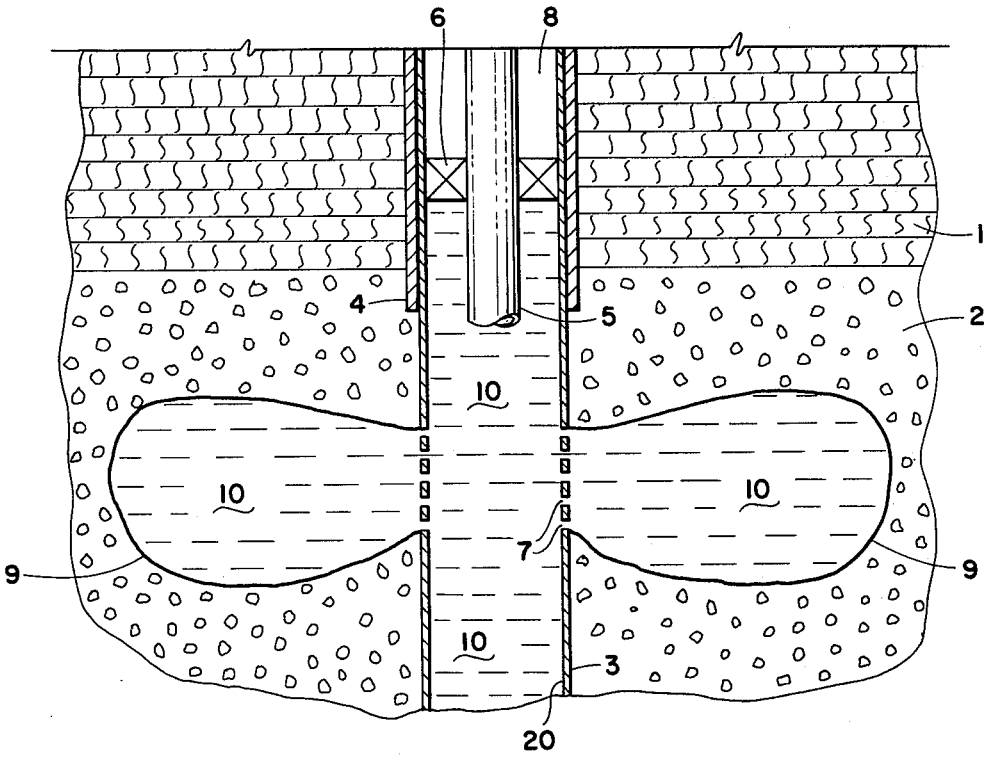
FIGS. 1–12 are cross-sectional side views showing the plane of a vertical fracture in a subterranean formation penetrated by a borehole, schematically depicting what is believed to be occurring in the fracture as each stage of a preferred embodiment of the present invention is carried out.
Figure 2:
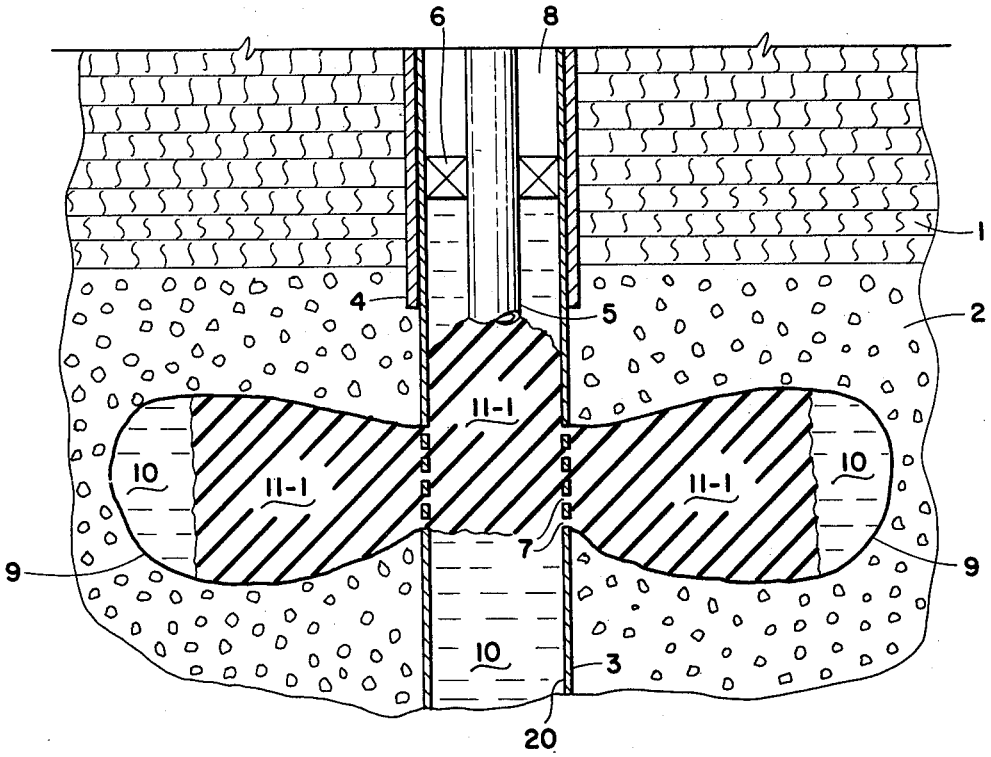

By a "viscous non-Newtonian fluid", "high viscosity non-Newtonian fracturing fluid" and like terms is meant a fluid having non-Newtonian flow properties, and a viscosity at the formation temperature of from about 10 to about 400 centipoise, preferably about 50–300 cps. Examples of high-viscosity non-Newtonian fluids which may be employed in the present invention are water gels, hydrocarbon gels and hydrocarbon-in-water or, optionally, water-in-hydrocarbon emulsions. Suitable water gels may be formed by combining water or certain brines with natural gums and derivatives thereof, such as guar or hydroxypropyl guar, carboxymethyl cellulose, carboxymethyl hydroxy ethyl cellulose, polyacrylamide and starches. Chemical complexes of the above compounds formed through chemical cross-linking may also be employed in the present invention. Such complexes may be formed with various metal complexers such as borate, copper, nickel and zirconium. Representative embodiments include those described in Kern, U.S. Pat. No. 3,058,909; Chrisp, U.S. Pat. Nos. 3,202,556 and 3,301,723; Jordan, U.S. Pat. No. 3,251,781; and Tiner et al., U.S. Pat. No. 3,888,312. Other chemical complexes of the above materials may be used which are formed by organic complexers such as hexamethoxymethylmelamine. Fluids low in viscosity at the wellhead which gel prior to reaching the formation, such as disclosed by Free, U.S. Pat. No. 3,974,077 may also be employed. Examples of hydrocarbon gels which may be employed in the present invention are those gels which are formed when a hydrocarbon liquid such as kerosene is combined with metallic soaps, polyisobutylene poly alkyl styrene, isobutyl acrylate, isobutyl methacrylate and aluminum soaps. See. for example, Crawford et al., U.S. Pat. No. 3,757,864. As will be understood by those skilled in the art, many other highly viscous non-Newtonian types of materials may be employed in the present invention. These materials may behave as either plastic fluids, pseudoplastic fluids, or yield pseudoplastic fluids. Plastic fluids will require some stress which must be exceeded before flow starts, and thereafter a plot of shear stress vs. shear rate exhibits substantially linear behavior. Pseudoplastic fluids, although having no defined yield point, will yield high apparent viscosities at low shear rates in laminar flow. Yield pseudoplastic fluids like plastic fluids, have a finite yield point, but thereafter exhibit non-linear behavior.

By "low viscosity penetrating fluid", "inefficient penetrating fluid" and like terms is meant a fluid which has sufficiently low viscosity and sufficiently high fluid loss so that the fluid can be injected into the fractured formation at a rate of at least about ¼ barrel per minute at a pressure insufficient to prevent the faces of the fracture from closing upon proppant in said fracture. Preferably, the low viscosity penetrating fluid has a viscosity at the formation temperature of less than about 1.5 centipoise, though in extremely porous formations, fluids having a viscosity of up to 5 cps or even 10 cps may be employed. Suitable low viscosity fluids include water, brine, and acids, including hydrochloric, or a mixture of hydrochloric and hydrofluoric acids. Organic acids may also be employed, such as citric and formic acids, alone or in combination with one another or with inorganic acids. Acids will normally contain a suitable corrosion inhibitor. Low viscosity hydrocarbons may also be employed, such as butane, propane, diesel oil, or crude oil. Condensed carbon dioxide may also be employed, alone or dissolved in another fluid, provided it is not permitted to vaporize until after the fracture has healed sufficiently to hold the proppant in place. The low viscosity penetrating fluid is substantially free of gelling agents, but may contain minor amounts of such agents sufficient to significantly improve friction loss in the fluid, but not sufficient to significantly increase the viscosity thereof. For example, U.S. Pat. No. 3,757,864 teaches that the phosphate esters there described may be employed at different concentrations depending whether it is desired to gel the hydrocarbon or merely reduce friction loss. The low viscosity penetrating fluid is selected so as to render the fracture cavity substantially free of high viscosity non-Newtonian fluid, e.g. by displacement, substantial dilution, breaking of the gel, or the like, so that the remaining fluid in the fracture cavity has substantially less solids transport capacity and substantially greater fluid loss than the high viscosity non-Newtonian fluid previously occupying the cavity.

It will be noted that the viscosity ranges set forth in the preceding definitions both read on about 10 cps. However, the preceding ranges have been set with all types of formations in mind. In any particular formation, the viscosity of the viscous non-Newtonian fluid in centipoise should exceed that of the low viscosity penetrating fluid by at least 10 times and preferably 100 times. Additionally, each stage of viscous non-Newtonian fluid should have a viscosity at least about as great as the stage of viscous non-Newtonian fluid preceding it. In actual practice, it is logistically expedient to employ the same fluid for each stage of viscous non-Newtonian fluid throughout the treatment.

By "matrix rate" is meant a finite injection rate, but one which is sufficiently low so that the fluid is lost to the formation without exerting sufficient pressure upon the formation to prevent the new fractures from substantially completely closing upon proppant contained in the fracture. While the upper pressure limit for some formations may be slightly higher, an injection rate resulting in a formation pressure of less than about 0.7 pounds per square inch per foot of depth can safely be considered to be a matrix rate. As those skilled in the art recognize, one can obtain the formation pressure from the wellhead pressure by subtracting the friction loss in the wellbore and adding the pressure exerted by the hydrostatic head.

Referring generally to FIGS. 1 through 12 and 19, there is shown a segment of a wellbore 3 penetrating through a very low permeability low or non permeable subterranean formation 1 and into a permeable formation 2. The wellbore 3 is equipped with casing 20 sealed in place with cement 4 and provided with a plurality of perforations 7. To minimize congestion in the Figures, cement 4 is shown as terminating above perforations 7, although those skilled in the art will recognize that in practice, the cement normally extends to the bottom of the casing 20 as shown, for example, in the Figures of U.S. Pat. No. 3,335,797 and as discussed at column 3, lines 35–37 of said patent. Treatment fluids according to the present invention may be injected through the full volume of the casing, or, as shown in the Figures, down tubing 5 set on a packer 6 which isolates the annulus 8.

The formation contains an initial fracture which may be preexisting, e.g. a natural fracture or a fracture created during an earlier fracturing treatment, or, as shown in FIG. 1, a fracture 9 may be initiated as a preliminary step by injection of a formation-compatible conventional fracturing fluid 10 at a rate and pressure sufficient to initiate the fracture. The composition of fracturing fluid 10 is not critical, as those skilled in the art will recognize. See, for example, U.S. Pat. No. 3,592,266, column 4, lines 5–10. Water, brine, acid, crude oil, diesel oil, emulsions, and the like may be employed. Various known friction reducers, gelling agents, fluid loss agents, and the like may be employed in the fluid if desired. Preferably, the fluid 10 used for initiating formation breakdown has a viscosity of from about 5 to about 40 centipoise, and the viscosity of the pad 11-1 of high viscosity non-Newtonian fluid is at least about as great as that of the initiating fluid 10. If desired, the same fluid can be used as both the breakdown fluid 10 and the fracture extending fluid 11-1.

After a fracture 9 has been initiated, a preselected volume of viscous non-Newtonian fluid 11-1 containing substantially no solids is injected at a rate calculated to widen the fracture sufficiently to accept solid particles of propping agents, and extend the fracture a preselected distance. The fluid 11-1 may contain a sufficient quantity of extremely fine particulate, e.g. that which passes a 200 mesh screen, if desired for fluid loss control. The approximate volume and dimensions of a fracture can be predicted with sufficient accuracy by those skilled in the art based on rock hardness, permeability, and porosity data, the fluid injection rate, and the flow properties of the fluid, i.e. viscosity, friction loss, and fluid loss. Thus, the volume of pad fluid 11-1 employed will vary considerably depending on many parameters, but a volume of about 5,000–20,000 gallons is typical.

Following the proppant free pad 11-1, a viscous non-Newtonian fluid 12-1 carrying solid particulate 25-1 is injected in an amount calculated to fill a portion of the fracture with the particulate. The total volume of particulate bearing fluid employed between relaxation steps is generally from 10,000–50,000 gallons, and more typically, about 15,000–30,000 gallons, though these figures are included by way of example only and are by no means critical limitations. The rate of injection, usually at least about as great as the rate of injection of the pad 11-1, is at least sufficient to prevent the fracture from closing, and to keep the particulate from settling before in position in the fracture. The particulate is employed in amounts of from about 0.5 to about 10 pounds of proppant per gallon of proppant laden fluid, preferably about 2–5 pounds per gallon depending on prop density and size, and fluid viscosity and flow rate.

Figure 19:
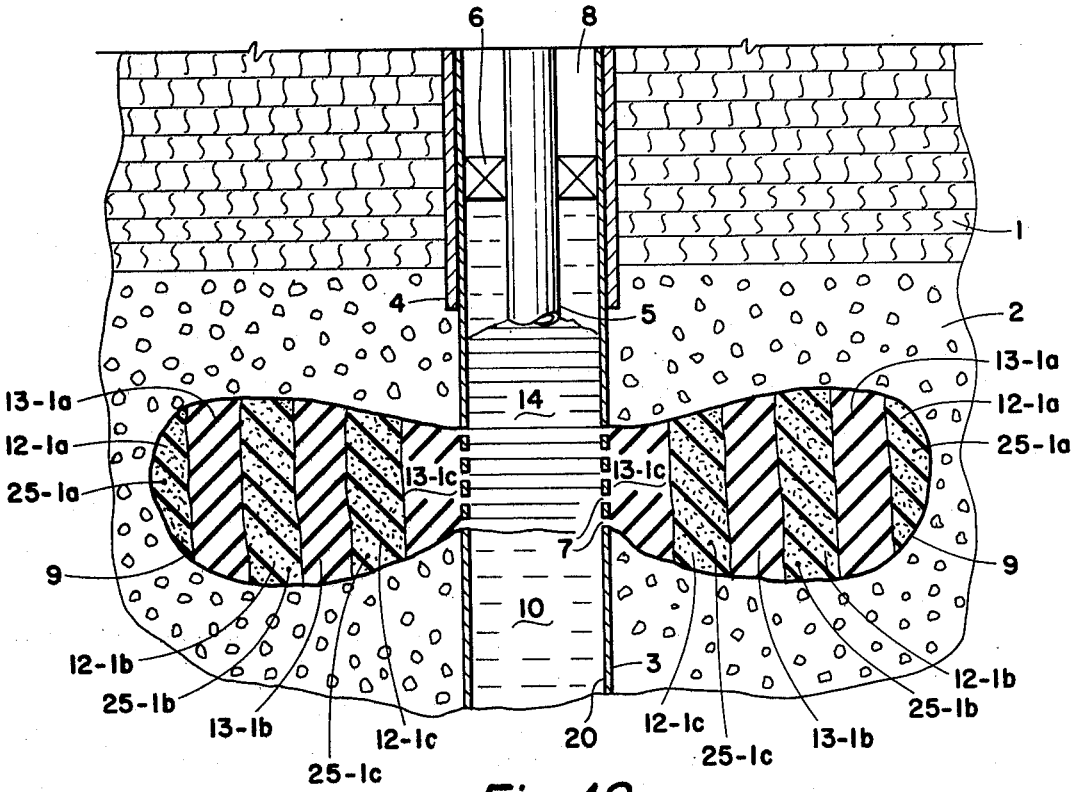
FIG. 19 shows the same view of a slight variation of the foregoing embodiment.

The particulate employed is principally intended to function as a propping agent, and may be graded sand, polymer coated sand, glass beads, walnut shells, alumina, sintered bauxite, zirconium oxide, steel beads, or other high stress particulate of suitable size, e.g. from about 4 to about 180 mesh, U.S. Sieve Series. Preferably, several size ranges of proppant are employed in a single fracture, e.g. 80–180 mesh, 60–80 mesh, 8–12 mesh, and/or 4–6 mesh, depending on the fracture width and desired degree of permeability. Frequently, as illustrated in FIG. 19, two or more sizes of proppant 25-1*a*, 25-1*b*, etc., are injected in several smaller stages between each relaxation step, with the smaller size proppant being injected first. For example, a portion of the treatment may include the following steps: . . . penetrating fluid at matrix rate, viscous fluid, viscous fluid with 100 mesh sand, viscous fluid, viscous fluid with 60–80 mesh sand, viscous fluid, viscous fluid with 20–40 mesh sand, viscous fluid, penetrating fluid, penetrating fluid at matrix rate, etc. As mentioned above, the proppant is believed to function not only as a proppant in the conventional sense of keeping the fracture open when production is resumed, but also as a barrier to further propagation of the fracture at the extremeties, which, during the subsequent steps of the invention, are believed to cause multiple secondary fractures to occur in communication with the main fracture plane, as illustrated in FIGS. 14 through 18. The direction of the secondary fractures is determined by formation stresses. An effective balance between good barrier effect during fracturing (which is optimized with smaller particle sizes), and good fracture permeability upon return to production (which is optimized with larger particle sizes), is found by employing about 20 to 40 weight percent proppant having a size of about 80–180 mesh, and the balance of proppant having a size of about 20–40 mesh. Additionally, the smaller sizes of proppant, e.g. less than 80 mesh, function to some extent as fluid loss agents.

Figure 3:
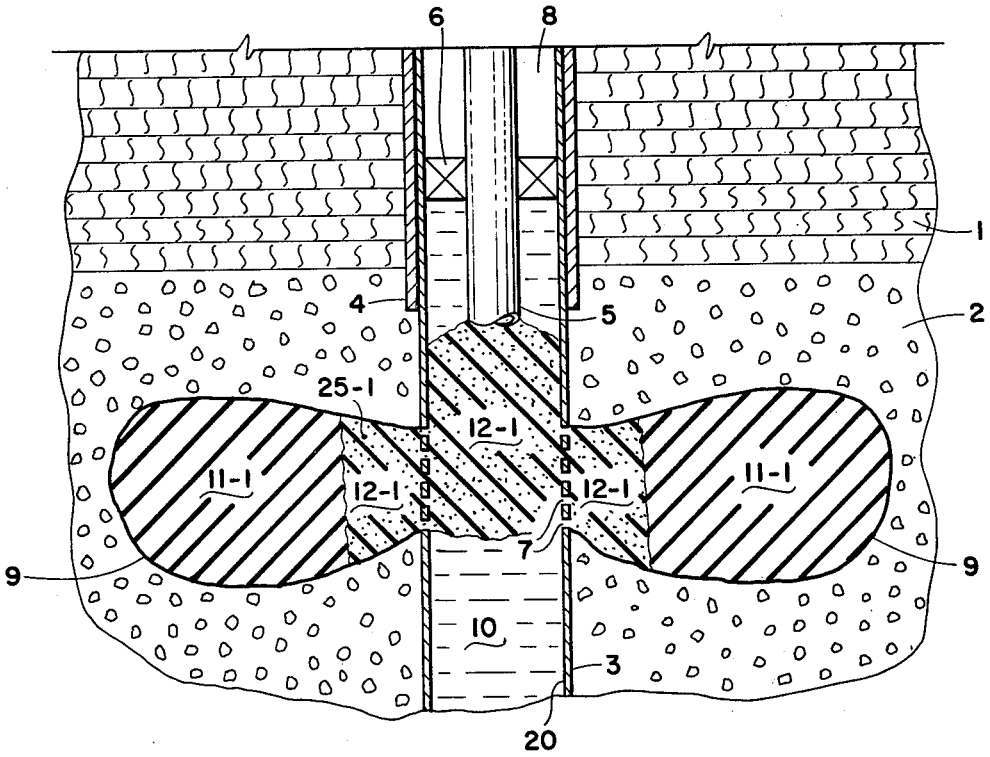
Figure 4:
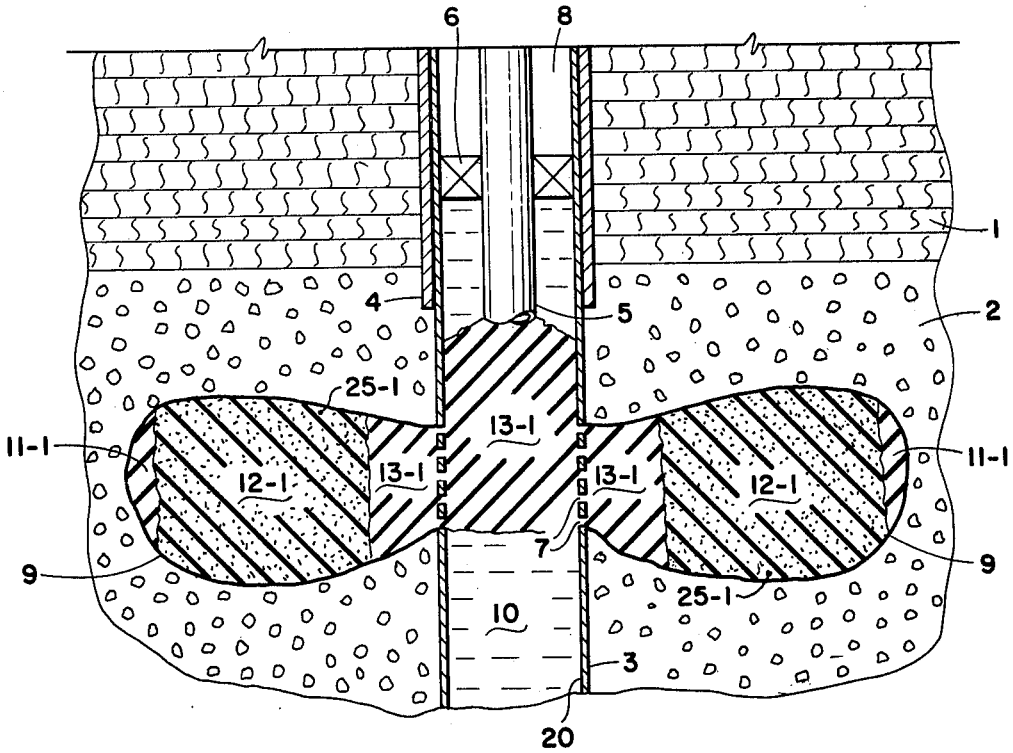

Returning to the embodiment illustrated in FIGS. 1–18, and referring to FIGS. 3 and 4 in particular, the viscous pad 11-1 is displaced by the proppant laden fluid 12-1, which in turn is displaced by a spacer or displacement pad 13-1 of substantially solids-free viscous non-Newtonian fluid. A volume of spacer 13-1 calculated to be at least sufficient to displace the proppant bearing fluid 12-1, and the proppant 25-1, to the viscinity of the extremeties of the fracture is employed, e.g. a volume at least about equal to the estimated fracture volume.

Spacer 13-1 is injected at a rate calculated to be sufficient to maintain the fracture open to its maximum width and to maintain the flow rate of the proppant laden fluid 12-1 within the formation sufficient to assure that premature deposition of the proppant 25-1 does not occur.

Figure 5:
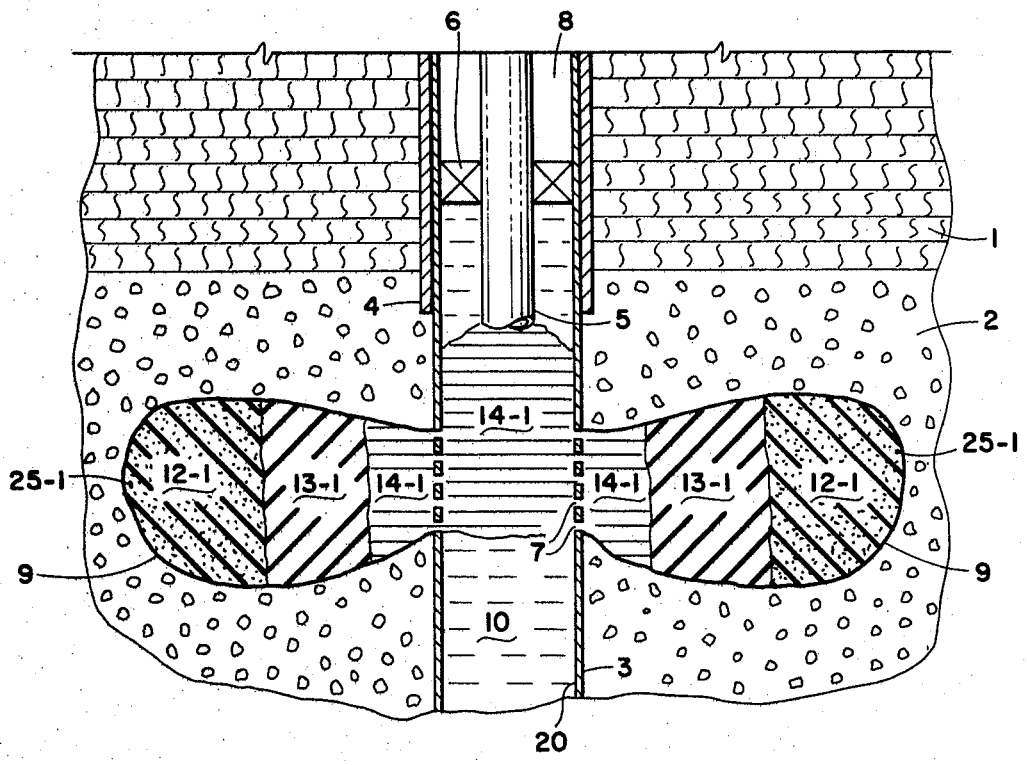
Figure 6:
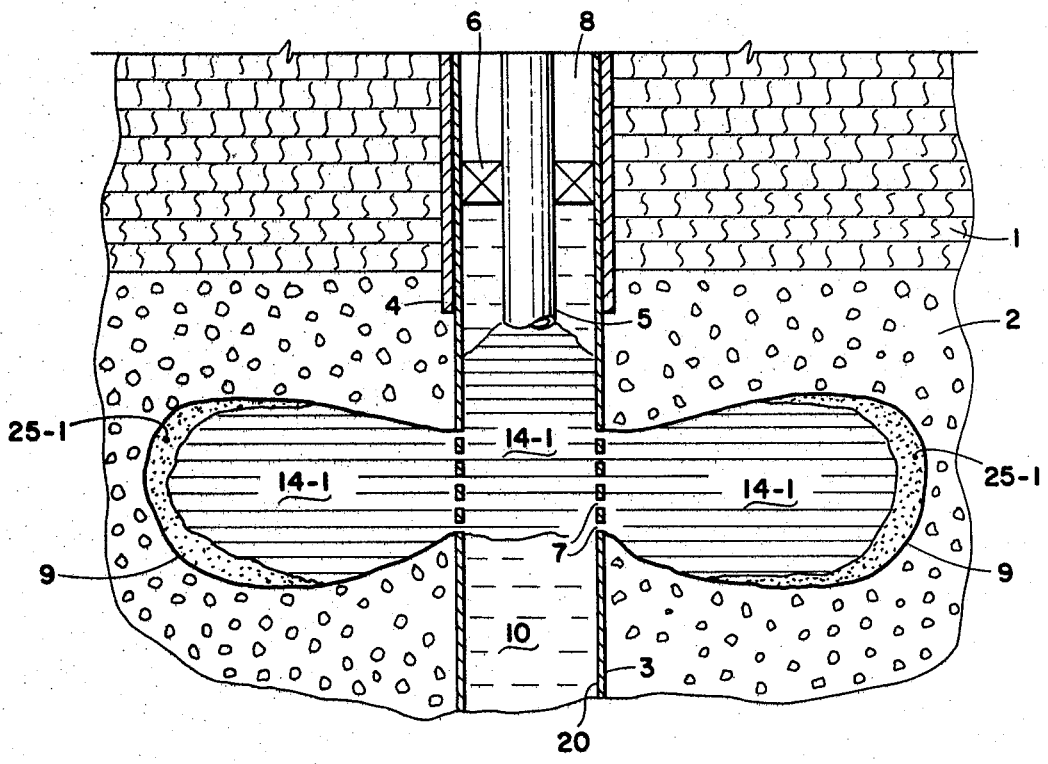
Figure 7:
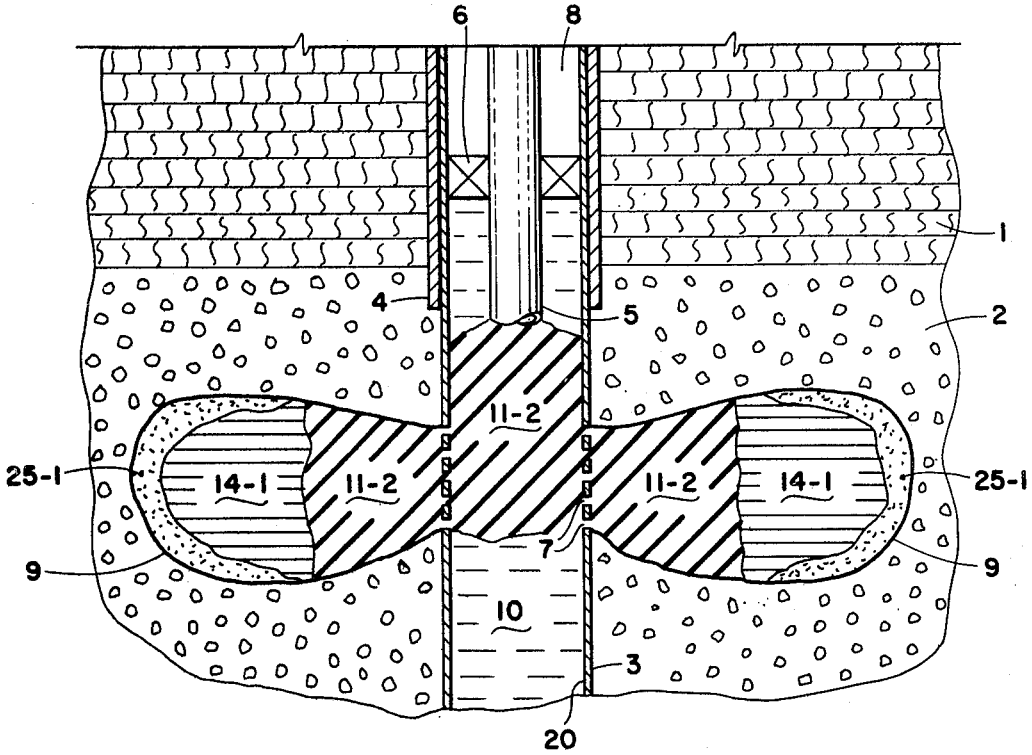
Figure 8:
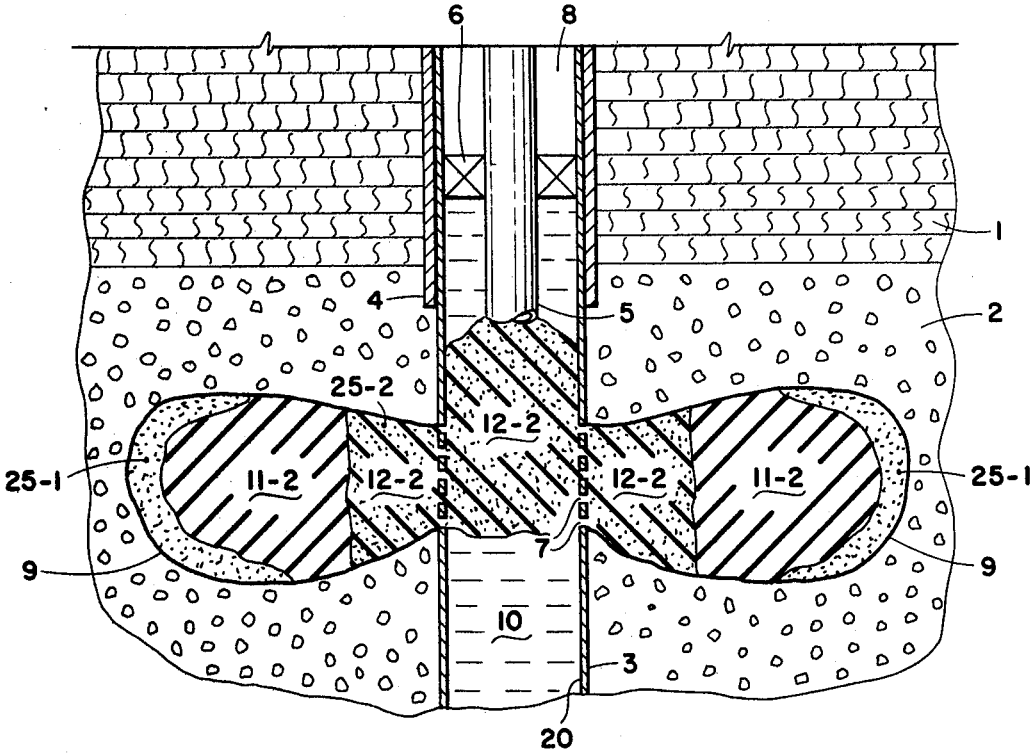
Figure 9:
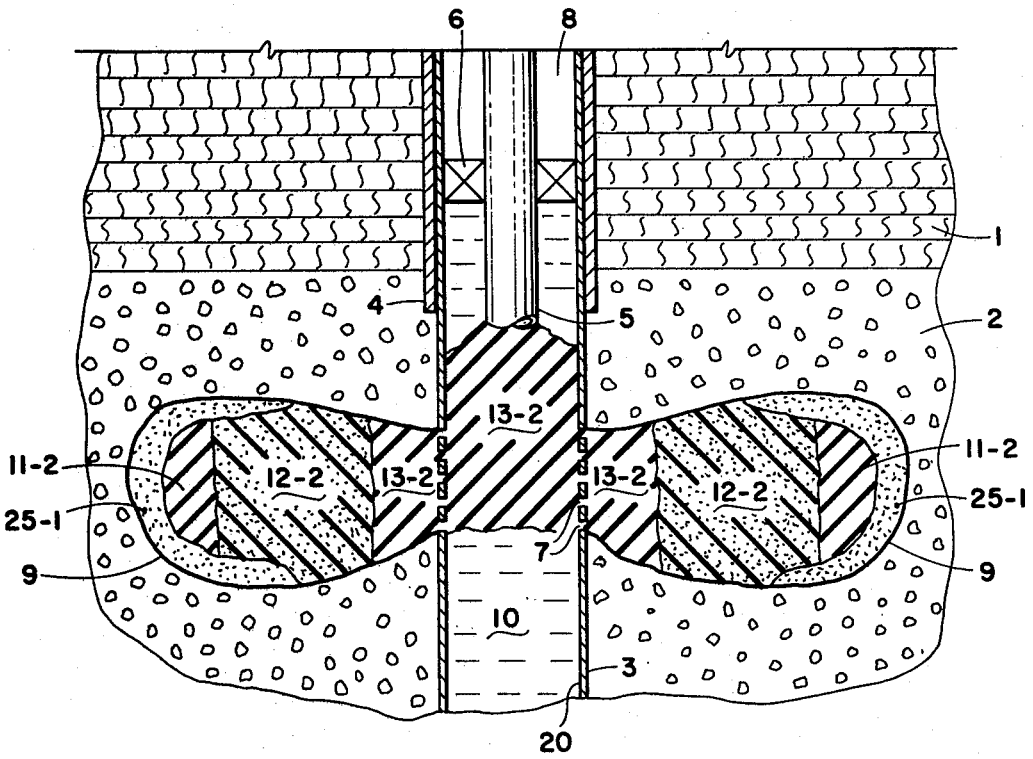
Figure 10:
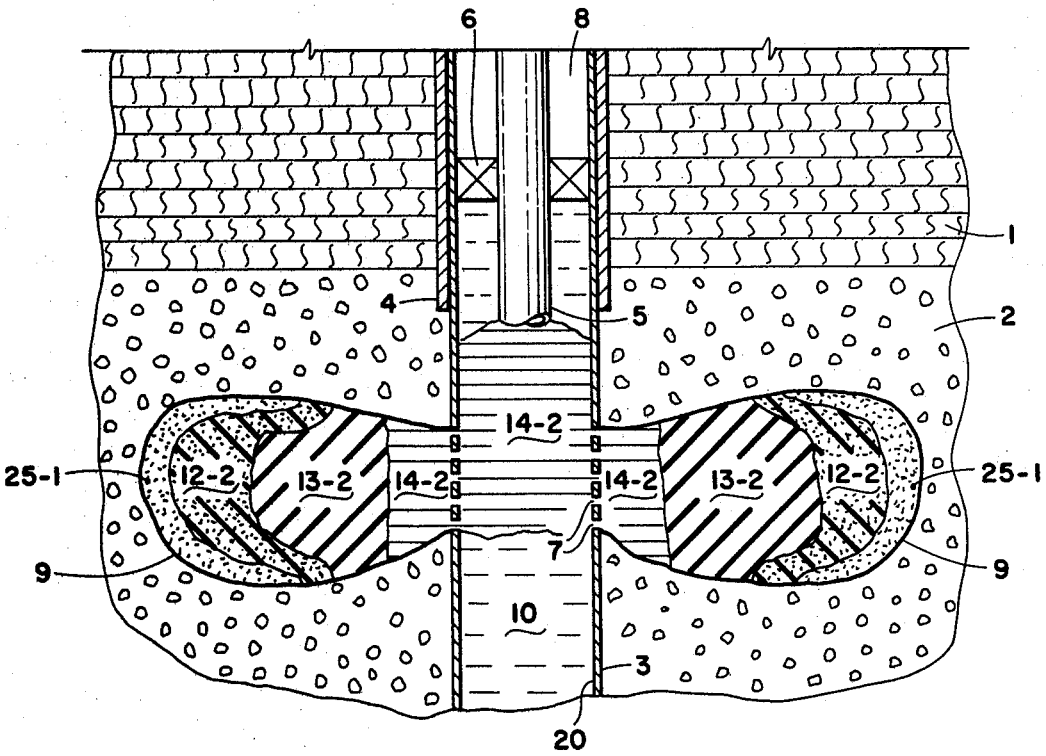
Figure 11:
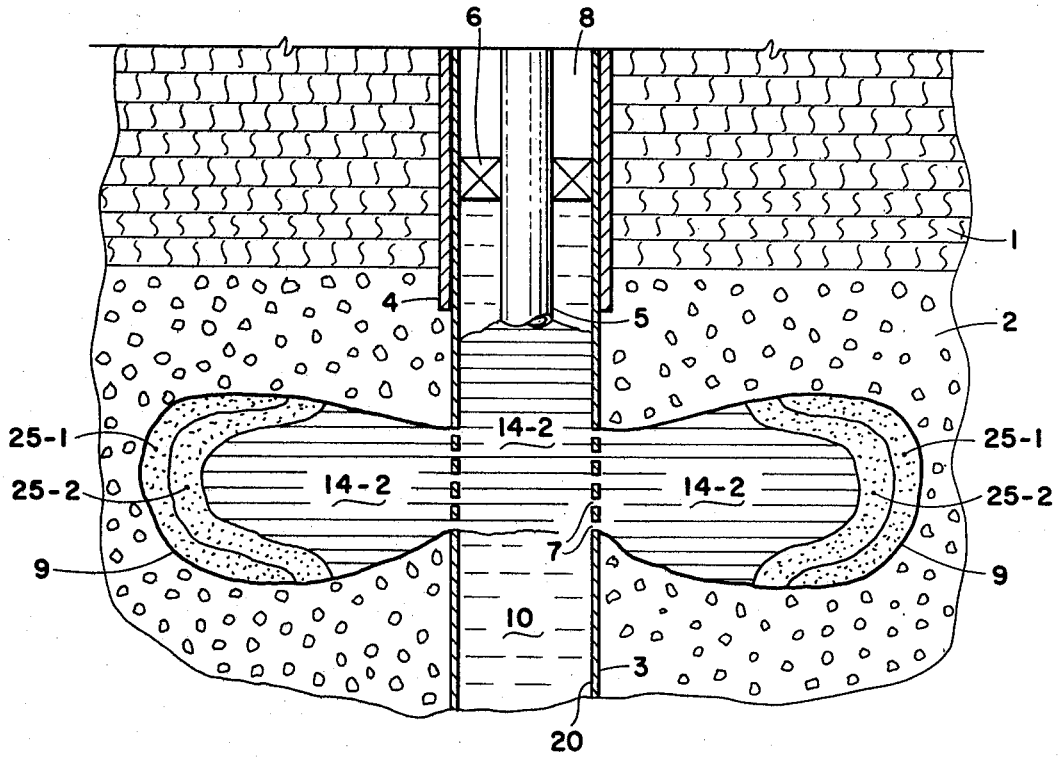
Figure 12:
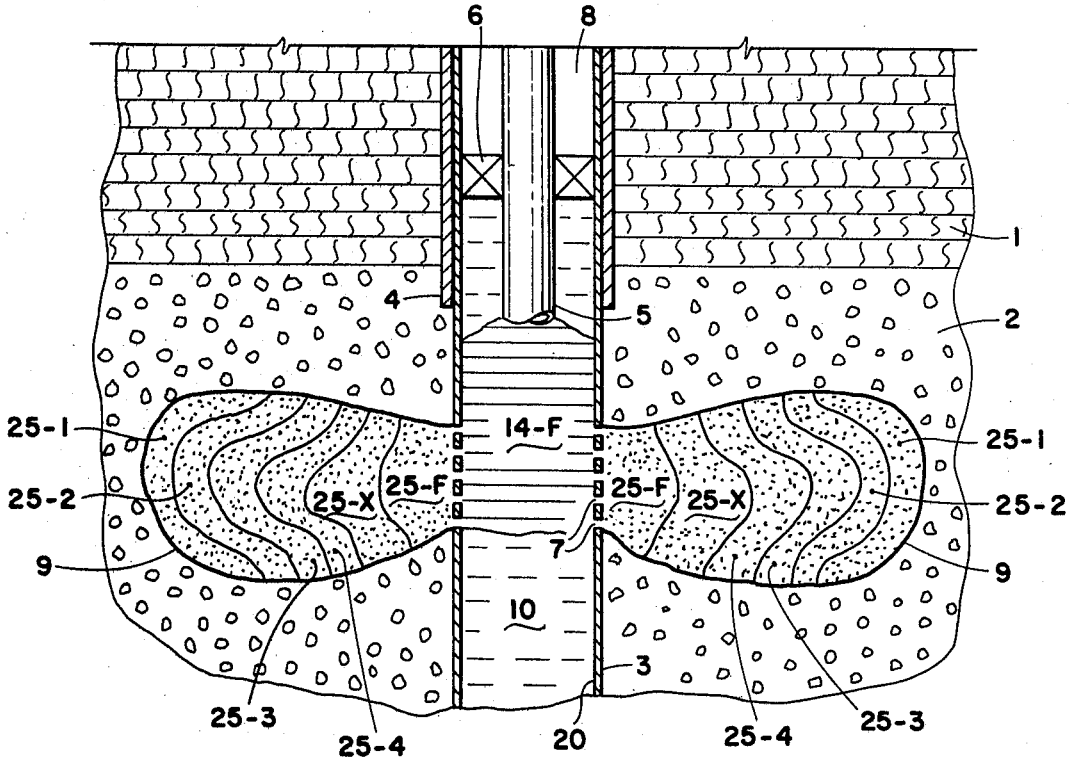
Figure 13:
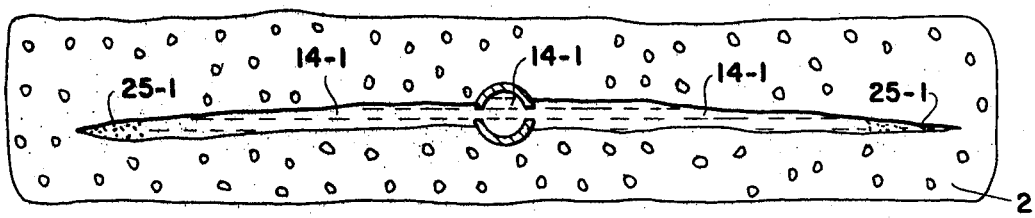
FIGS. 13–18 are schematic cross-sectional top views showing a horizontal plane through the same subterranean formation. Obviously, the various features are not intended to be shown in scale proportion to one another. Identical elements have identical numerals throughout. Similar fluids of different stages have a common hyphenated reference numeral throughout, with the digit following the hyphen designating the stage. Specifically.
Figure 14:
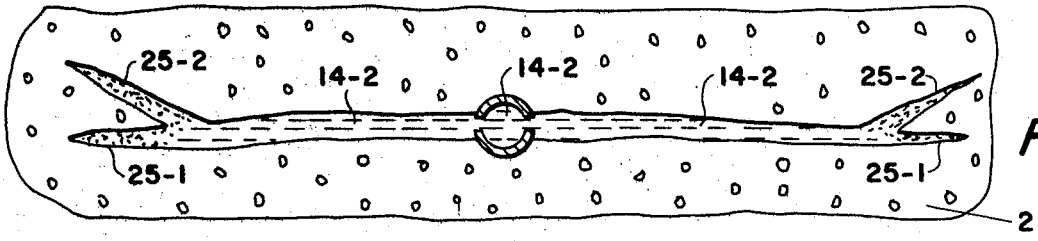
Figure 15:
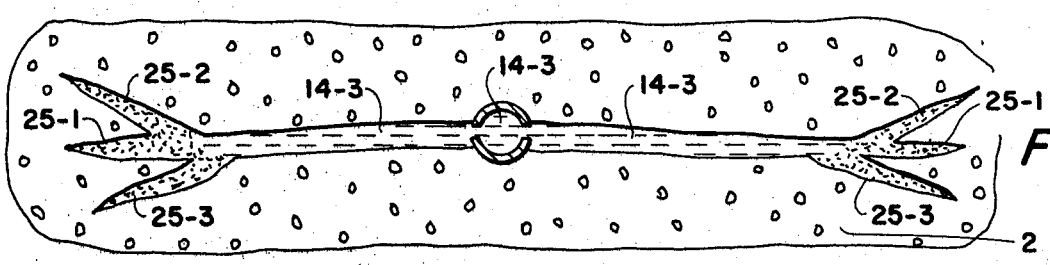
Figure 16:
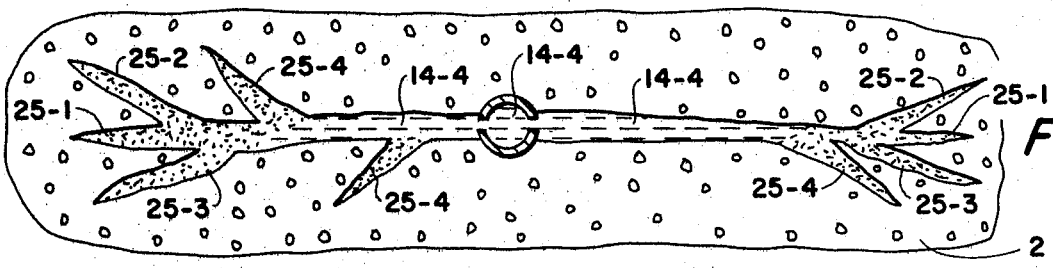
Figure 17:
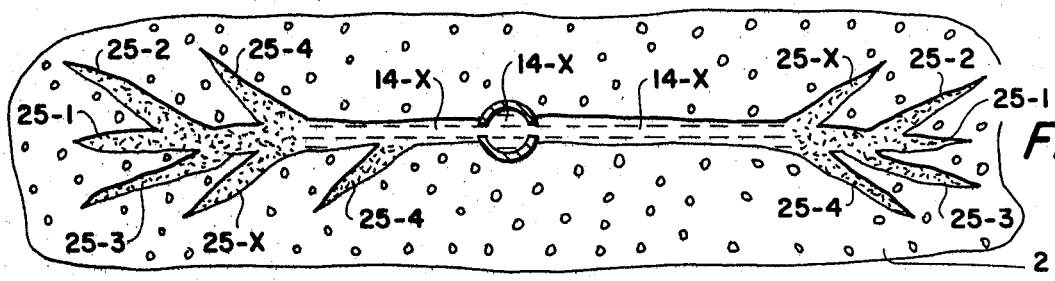
Figure 18:
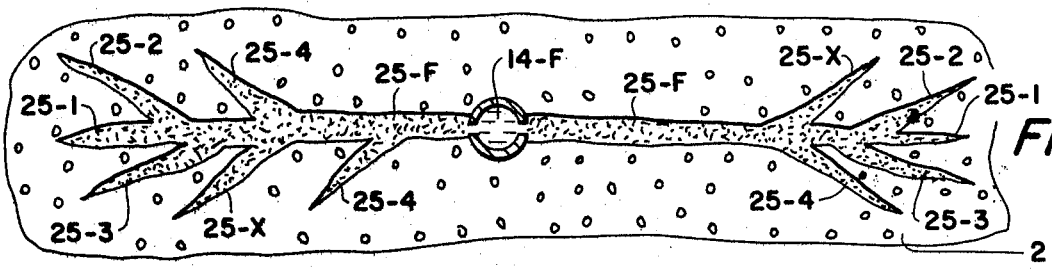

Referring now to FIGS. 5 and 19, immediately following injection of spacer 13-1, or in the embodiment of FIG. 19 wherein several smaller volumes of proppant fluid 12-1*a*, 12-1*b*, and 12-1*c* are injected then immediately following the final stage 13-1*c* of substantially proppant free spacer, a low viscosity penetrating fluid 14-1 is injected. The rate at which penetrating fluid 14-1 is injected, as measured at the wellhead, is substantially the same as that at which the spacer 13-1 was injected, and this rate is maintained until a volume at least approximately equal to the estimated fracture void has been injected into the formation, and preferably until a 10 to 25 volume percent excess has been injected to assure that the viscous non-Newtonian fluids have been substantially displaced from the fracture, diluted, or otherwise rendered substantially less viscous. Since the penetrating fluid 14-1 will sustain more rapid leakoff into the formation than the viscous non-Newtonian fluid, slight relaxation of the fracture is believed to begin occurring during the high rate injection of penetrating fluid 14-1, but the fracture is still believed to retain most of its maximum width at this point in time.

Next, injection of fluids at rates and pressures calculated to prevent the fracture from healing substantially is ceased. The healing step may comprise a complete shutdown of wellhead operations, or, a flowing back of the well as taught in columns 25–30 of Kiel, U.S. Pat. No. 3,933,205, or, continued injection of the penetrating fluid 14-1 but at a matrix rate, as hereinabove defined. As illustrated beginning with FIG. 7, a second stage of solids free viscous non-Newtonian fluid 11-2 is injected at a fracturing rate and pressure, followed by a second stage of viscous non-Newtonian fluid 12-2 carrying particulate fluid loss and/or propping agent 25-2. If desired, and if the entire fracture contains sufficient propping agent, the treatment can be terminated after injection of fluid 12-2. However, most benefit is realized if the treatment is planned so that several cycles of proppant injection and fracture healing occur during the course of the treatment. Thus, FIGS. 9 through 12 illustrate the second-cycle injection of viscous spacer fluid 13-2, penetrating fluid 14-2, and matrix rate injection of penetrating fluid 14-2 which are carried out, thereby depositing a second stage of proppant, 25-2 (see also FIG. 14). The same sequence of steps may be repeated a third, fourth, and Xth time, depending on treatment design, as illustrated in FIGS. 12, and 15 through 17. The final injection of viscous non-Newtonian fluid carrying a proppant 25-F is preferably designed so that the remaining fracture void will contain proppant substantially to the vicinity of the wellbore. Also, it is preferred to employ a relatively large size proppant 25-F so that the fracture has a particularly high conductivity near the wellbore, e.g. a conductivity ratio of 10 or greater over the formation itself, thereby permitting maximum productivity of formation fluids upon completion.

Following completion of the healing step, the extremeties of the fracture are believed to contain barriers of proppant 25-1 which prevent further extension of the fracture at these extremeties. As subsequent stages of the treatment are carried out, therefore, secondary fractures are created in communication with the main fracture resulting in a higher sustained productivity of formation fluids. The secondary fractures are also beneficial where the well is to be an injection well. In one specialized application, the invention can be beneficially employed in a method of extinguishing well fires. In such an application, the method is practiced through a well adjacent a well which is on fire until a fracture pattern results which initiates or improves upon fluid communication between the two wells through the formation. A fire extinguishing composition is then injected down the adjacent well and thence into the burning well through the newly created fracture pattern to thereby extinguish the fire.

New wells treated in Dimmit County, Texas, and elsewhere according to the procedure described herein produced two to three times better than offset wells fractured according to conventional techniques using no multiple stages. In the treatments performed according to the present invention, the base viscous non-Newtonian fluid employed was an aqueous borate cross-linked guar (40 lbs guar/1000 gallons fluid) fluid and the penetrating fluids have been water or dilute HCl containing 2 to 5 lbs friction reducer per 1000 gallons of fluid.

What is claimed is:

1. In a method of fracturing a formation wherein at least two stages of a viscous non-Newtonian fracturing fluid carrying a solid are injected via a borehole into a fracture in said formation at a fracturing rate and pressure, and fluid injection rates and pressures are temporarily reduced at least once between the first and the last of said stages to close the fracture at least partially, the improvement which comprises: immediately preceding the temporary rate and pressure reducing step, injecting in sequence both (a) a non-Newtonian viscous fracturing fluid substantially free of solids and (b) an inefficient penetrating fluid substantially free of solids.

2. The method of claim 1 wherein said temporary rate and pressure reducing step comprises continuing to inject said inefficient penetrating fluid, but at a matrix rate.

3. The method of claim 2 wherein the matrix rate is a rate resulting in a formation pressure of less than about 0.7 pounds per square inch per foot of depth.

4. The method of claim 2 wherein the viscosity of the penetrating fluid is less than about 1.5 centipoise and the viscosity of the non-Newtonian fluid is from about 10 to about 400 centipoise, the viscosity of the non-Newtonian fluid being further characterized as exceeding that of the penetrating fluid by at least 10 times.

5. The method of claim 1 wherein said borehole is adjacent a second borehole, said second borehole is on fire, and said steps recited in claim 1 are carried out so that fluid communication between said boreholes through said formation is established or improved, comprising the additional step subsequent to said steps recited in claim 1 of injecting into said second borehole via said formation and said first borehole, an effective quantity of a fire extinguishing composition so that said fire is extinguished.

6. In a method for increasing the permeability of a subterranean formation penetrated by a borehole which includes the steps of (i) injecting a high viscosity, non-Newtonian fluid substantially free of solids into a fracture in the formation which is in communication with the borehole, at a fracturing rate and pressure sufficient to widen the fracture so that a propping agent can be injected into the fracture, (ii) injecting a high viscosity non-Newtonian fluid carrying a propping agent while continuing to maintain a wellhead injection rate and pressure calculated to prevent said fracture from healing, (iii) injecting a high viscosity non-Newtonian spacer fluid substantially free of solids while continuing to maintain a wellhead injection rate and pressure calculated to prevent said fracture from healing, (iv) temporarily ceasing to inject fluids at rates and pressures calculated to prevent said fracture from healing, (v) repeating steps (i) and (ii) at least once, and (vi) terminating the treatment by permanently ceasing to inject fluids, the improvement which comprises:

(a) immediately preceding step (iv), injecting a stage of a substantially solids-free inefficient penetrating fluid less viscous than said non-Newtonian fluids while continuing to maintain a wellhead injection rate calculated to substantially prevent said fracture from healing.

7. The method of claim 6 wherein step (iv) comprises injecting an inefficient fluid less viscous than said non-Newtonian fluid at a matrix rate.

8. The method of claim 7 wherein step (iv) consists of injecting an inefficient fluid less viscous than said non-Newtonian fluid at a matrix rate.

9. The method of claim 6 wherein step (v) includes repeating steps (i) through (iii) at least once.

10. The method of claim 9 wherein step (iv) consists of injecting an inefficient fluid less viscous than said non-Newtonian fluid at a matrix rate.

11. The method of claim 6 wherein step (v) includes repeating steps (i) through (iv) at least once, the penetrating fluid injection step being carried out immediately prior to each repetition of step (iv).

12. The method of claim 11 wherein step (iv) consists of injecting an inefficient fluid less viscous than said non-Newtonian fluid at a matrix rate.

13. The method of claim 6 including an initial step of injecting a fracturing fluid into said formation at a rate and pressure sufficient to initiate a fracture in said formation in communication with said borehole.

14. The method of claim 6 wherein said non-Newtonian fluid is selected from the group consisting of a gelled aqueous fluid, or an oil-in-water emulsion, and wherein said fluid of step (a) is water, brine, an aqueous acid solution or a liquified inert inorganic gas.

15. The method of claim 6 wherein said non-Newtonian fluid is selected from the group consisting of a gelled hydrocarbon or a water-in-oil emulsion and wherein said fluid of step (a) is a hydrocarbon.

16. A method of treating a subterranean formation penetrated by a borehole to increase the permeability thereof, said formation having at least one fracture therein in communication with said borehole, comprising (a) injecting a high viscosity non-Newtonian pad fluid substantially free of solids into said fracture at a rate and pressure sufficient to extend said fracture and widen the fracture sufficiently so that a propping agent can be injected into the fracture;

(b) placing propping agent in said fracture by (1) injecting a high viscosity non-Newtonian carrier fluid having a propping agent suspended therein while continuing to maintain a wellhead injection rate and pressure calculated to prevent said fracture from healing and (2) injecting a high viscosity non-Newtonian spacer fluid substantially free of solids into said fracture at a rate and pressure calculated to prevent said fracture from healing;

(c) repeating step (b) at least once;

(d) injecting an inefficient penetrating fluid less viscous than said non-Newtonian fluid;

(e) temporarily ceasing to inject fluids at rates and pressures calculated to prevent said fracture from healing;

(f) repeating steps (a) through (d) at least once; and (g) terminating the treatment by permanently ceasing to inject fluids.

17. The method of claim 16 wherein step (e) comprises injecting an inefficient penetrating fluid less viscous than said non-Newtonian fluids at a matrix rate.

18. The method of claim 17 wherein step (e) consists of injecting an inefficient penetrating fluid less viscous than said non-Newtonian fluids at a matrix rate.

* * * * *